US011951348B2

(12) United States Patent
Falahi

(10) Patent No.: US 11,951,348 B2
(45) Date of Patent: Apr. 9, 2024

(54) EXERCISE SYSTEM

(71) Applicant: Justin Falahi, Encino, CA (US)

(72) Inventor: Justin Falahi, Encino, CA (US)

( * ) Notice: Subject to any disclaimer, the term of this patent is extended or adjusted under 35 U.S.C. 154(b) by 21 days.

(21) Appl. No.: 17/546,341

(22) Filed: Dec. 9, 2021

(65) Prior Publication Data

US 2022/0176187 A1 Jun. 9, 2022

Related U.S. Application Data

(60) Provisional application No. 63/123,036, filed on Dec. 9, 2020.

(51) Int. Cl.

| | |
|---|---|
| ***A63B 21/16*** | (2006.01) |
| ***A63B 21/04*** | (2006.01) |
| ***A63B 21/055*** | (2006.01) |
| ***A63B 65/06*** | (2006.01) |

(52) U.S. Cl.

CPC ..... *A63B 21/169* (2015.10); *A63B 21/0442* (2013.01); *A63B 21/0557* (2013.01); *A63B 65/06* (2013.01)

(58) Field of Classification Search

CPC ..... A63B 21/169; A63B 21/0442; A63B 21/0557; A63B 65/06; A63B 21/00061; A63B 21/0555; A63B 21/08; A63B 2071/0694; A63B 21/4037

See application file for complete search history.

(56) References Cited

U.S. PATENT DOCUMENTS

| | | | | |
|---|---|---|---|---|
| 6,387,013 | B1 * | 5/2002 | Marquez | A63B 6/00 473/278 |
| 7,625,325 | B1 * | 12/2009 | Yost | A63B 21/169 482/904 |
| 7,648,449 | B1 * | 1/2010 | Detert | A63B 6/00 482/111 |
| 8,033,960 | B1 * | 10/2011 | Dalebout | A63B 23/03541 482/130 |
| 8,057,370 | B2 * | 11/2011 | Dunn | A63B 21/0552 482/904 |
| 8,157,712 | B1 * | 4/2012 | Musachio | A63B 21/4034 482/121 |
| 8,485,951 | B1 * | 7/2013 | Adams | A63B 21/00072 482/904 |
| D829,834 | S * | 10/2018 | Derwinger | A63B 6/00 D21/662 |
| 10,315,065 | B1 * | 6/2019 | Soba | A63B 21/151 |
| 11,478,674 | B1 * | 10/2022 | Kuka | A63B 21/0615 |
| 2003/0017915 | A1 * | 1/2003 | Prinzmetal | A63B 6/00 482/23 |
| 2003/0109324 | A1 * | 6/2003 | Novotny | A63B 69/3623 473/257 |
| 2003/0186792 | A1 * | 10/2003 | Keeler | A63B 21/4043 482/121 |
| 2007/0226904 | A1 * | 10/2007 | Huffman | A63B 23/12 5/417 |

(Continued)

*Primary Examiner* — Andrew S Lo

(74) *Attorney, Agent, or Firm* — KATTEN MUCHIN ROSENMAN LLP

(57) ABSTRACT

Disclosed herein is an exercise system comprising a wall mount having tie down anchors and an exercise mat. The exercise mat comprises a plurality of radial lines to ensure the user maintains a known distance from the wall mount. A first end of a resistance band is coupled to a tie down anchor and a second end of the exercise mat is coupled to a handle.

17 Claims, 7 Drawing Sheets

(56) References Cited

U.S. PATENT DOCUMENTS

| | | | | |
|---|---|---|---|---|
| 2008/0300118 | A1* | 12/2008 | Wehrell | A63B 21/169<br>482/129 |
| 2009/0239724 | A1* | 9/2009 | White | A63B 23/0244<br>482/142 |
| 2010/0048368 | A1* | 2/2010 | Donofrio | A63B 21/0552<br>482/130 |
| 2010/0197471 | A1* | 8/2010 | Hayes | A63B 23/0211<br>482/142 |
| 2010/0292057 | A1* | 11/2010 | Dunn | A63B 21/169<br>482/130 |
| 2011/0124427 | A1* | 5/2011 | Green | A63B 69/3661<br>473/409 |
| 2011/0237410 | A1* | 9/2011 | Perez | A63B 21/16<br>482/129 |
| 2013/0035220 | A1* | 2/2013 | Adams | A63B 21/0628<br>482/129 |
| 2014/0237718 | A1* | 8/2014 | Burch | A63B 21/4037<br>5/417 |
| 2015/0101123 | A1* | 4/2015 | Robo | A63B 21/4037<br>5/417 |
| 2015/0133278 | A1* | 5/2015 | Braier | A63B 21/0442<br>482/135 |
| 2016/0332023 | A1* | 11/2016 | Taylor | B32B 5/18 |
| 2019/0009157 | A1* | 1/2019 | Sudeith | A63B 21/0442 |
| 2020/0054929 | A1* | 2/2020 | Ward | A63B 24/0021 |
| 2020/0078628 | A1* | 3/2020 | Parise | A63B 21/0557 |
| 2020/0171349 | A1* | 6/2020 | Belmore | A63B 21/028 |
| 2020/0171369 | A1* | 6/2020 | Sudeith | A63B 69/0048 |
| 2021/0220691 | A1* | 7/2021 | Ivanov | A63B 21/0442 |

* cited by examiner

EXERCISE SYSTEM

CROSS-REFERENCE FOR RELATED APPLICATIONS

This application is claims priority to U.S. Provisional Application Ser. No. 63/123,036, filed Dec. 9, 2020, the entire contents of which are hereby incorporated by reference in their entirety.

FIELD OF THE INVENTION

The wall mounted exercise system of the present invention provides a wall mounted attachment device in combination with a floor mat that enable exercises to be reliably repeated bilaterally across different exercise sessions.

BACKGROUND

Exercise has many benefits that help to improve the overall health of the cardiovascular system, nervous system, circulation in the body, mood, metabolism, deeper sleep, speed up recovery and minimize effects of aging. In addition, exercise may enhance global cognition, and may also activate episodic memory-related pathways. Exercise may influence exercise-induced hippocampal growth, synaptic plasticity, and cue retrieval. The research details and implications of these findings enhance and preserve memory function due to the potential mechanisms of episodic memory and how exercise may activate these mechanistic pathways.

Exercise plays a huge role in helping to improve higher cognitive functionality. The declarative memory system is composed of three major components, including the cerebral cortex, the Para hippocampal region, and the hippocampus. The Para hippocampal region is the outer region of the hippocampus, and it serves as a convergence center for neocortical inputs and mediates two-way communication between cortical association areas and the hippocampus. The Para hippocampal region includes the perirhinal cortex, Para hippocampal cortex (or post-rhinal), and the entorhinal cortex. The hippocampus receives input from virtually all sensory domains; thus, declarative memory is accessible by many routes of cortical expression. Specifically, only highly preprocessed sensory information reaches the medial temporal lobe structures (neocortical areas create specific perceptual representations that can be sustained briefly within those processing areas), with these inputs coming from mostly higher-order cortical processing areas; perceptual or sensory information enters via the primary cortical areas, then passes through multiple secondary and tertiary stages of sensory processing that are segregated for each sensory modality.

As stated above, the route of communication goes from the cortex, to the Para hippocampal region, to the hippocampus. Thus, hippocampal processing relies on a series of cortical inputs. There are two types of information, the 'what' and 'where' information; which stream from separate pathways from the neocortical areas into the Para hippocampal region. The 'what' pathway enters the lateral part of the entorhinal cortex; the 'where' pathway enters the medial part of the entorhinal cortex. These separate streams (pathways) of information combine in the hippocampus, with the outputs of the hippocampus directed back to the Para hippocampal region, and then back to the cerebral cortex.

During the encoding of new memories, internal representations of new items (e.g., people, objects; 'what' information) are formed in the perirhinal and lateral entorhinal area; contextual ('where' information) internal representations are formed in the Para hippocampal and entorhinal area; and then, the 'what' and 'where' information is combined within the hippocampus as hippocampal neurons associate items with their context. Taken together, the perirhinal cortex is activated during memory processing of objects, the Para hippocampal cortex is activated during processing of contextual information, and the hippocampus is activated during the processing of associations. Additionally, whereas the hippocampal area is particularly important for recollection of information, the Para hippocampal cortical areas are involved in the familiarity of information (e.g., one may meet someone whose appearance seems familiar, but cannot recall their name or in what context they know them).

In animal models, exercise has been shown to increase hippocampal neurogenesis (concomitant increases in hippocampal volume/size), improve learning, and ameliorate some of the negative consequences associated with aging (e.g., decrement in neuronal populations), which may, in part, occur via the astrocyte—neuron lactate shuttle. A considerable amount of energy is required for action potential generation and neuronal transmission. Astrocytes, a glial cell type, exhibit relatively high rates of glycolysis, and the lactate produced by these cells is shuttled (via the ANLS) to neurons to fill their increased energy needs during synaptic transmission. Exercise has been shown to increase the effectiveness of the ANLS by upregulation of astrocytic lactate transporter levels.

The two main routes by which the Para hippocampal area projects into the hippocampus are the short and long pathways. The long pathway enters the perforant pathway, through the dentate gyms, to the CA3 cells, then the CA1 cells, and finally to the subiculum, which then has projections to subcortical areas. The short pathway bypasses the dentate gyms and CA3, projecting straight to the CA1 pyramidal cells.

Not only does exercise appear to induce advantageous neurological and structural changes in the hippocampus, specifically the dentate gyms, but animal research has also demonstrated that exercise is associated with increased dendritic spine density in the CA1 pyramidal neurons and the entorhinal cortex, as well as BDNF expression (which was associated with improved memory) in the perirhinal cortex. Exercise may help to augment dendritic spine density by increasing two synaptic growth proteins, namely PSD-95 and synaptophysin. Additionally, exercise may facilitate BDNF expression in the hippocampus via the PGC-1a/FNDC5 pathway Place cells, within the hippocampus, help to compose a 'cognitive map', which has been evaluated in animal models. Pyramidal neurons of the CA1 and CA3 fields of the hippocampus fire at high rates when the animal is in a particular location in the environment, but are activated little or not at all when the animal is in other places within the place field. This selective activation of neurons is not limited to spatiotemporal parameters, but also occurs during visual episodes.

Verbal memory performance is selectively compromised after left medial temporal lobe damage, and nonverbal memory performance is selectively compromised after right temporal lobe damage, suggesting that there is laterality in the medial temporal lobe contribution to memory.

Encouraging research demonstrates that exercise, prior to inducing temporal lobe damage, attenuates the damaging effects (e.g., seizure susceptibility. For example, in a rat temporal lobe epileptic model, exercise prior to epileptic seizure induction reduced the vulnerability to the insult, specifically, diminished frequency of seizures. Although speculative, potential mechanisms of this effect may include exercise-induced increases in melatonin levels, which have anticonvulsant actions.

The cellular basis of memory is often conceptualized as an engram trace, or a biological spatiotemporal internal representation (code) that resides in specific cell assemblies. Thus, engram cells are a population of neurons that are activated by learning, and once reactivated, memory recall ensues; no single neuron is essential to any percept or memory, as the assembly of neurons prevents the existence of a single cell homunculi.

There may also be various engram cell pathways that contribute to the overall contextual memory. For example, in the fear conditioning paradigm, auditory information may be stored in an engram in the auditory cortex; the context in which the tone occurred may be stored in the hippocampal engrams; and the association of the tone, context, and unconditioned stimulus (e.g., foot shocks) may be stored in the amygdala (positioned just anterior to the hippocampus) engram cells. Thus, these three populations of engram cells may constitute an engram cell pathway for the memory engram complex. These findings suggest that as internal memory representations are distributed over many neuronal nodes, localized lesions may fail to completely abolish a particular memory. Indeed, there is some evidence to suggest that the minimal number of neurons needed to encode and transmit physiological meaningful aspects of a visual scene may be close to $10^2$to $10^3$ neurons.

The identification of the engram has been evaluated using experimental infusion of immediate early gene (IEG) labeling and optogenetic technology (e.g., using dyes to measure neuronal activity, with light scattering caused by the local movement of water, ions, and released neurotransmitters). The expression of IEGs, such as c-fos, is a marker of neuronal activity. Thus, promoters of IEG can be used to tag neurons that are active during a learning task. In the fear conditioning paradigm, engram cells of the hippocampal dentate gyms have been labeled with channel rhodopsin-2 (ChR2), and their subsequent stimulation with blue light elicited a targeted fear memory, as measured by conditioned freezing behavior.

The current state of research suggests that dendritic spines, where excitatory synapses are located, may play an important role in the cellular unit for memory; that is, once a task is learned, that memory is stored in the engram cell that may be located in the dendritic spine.

DETAILED DESCRIPTION

The findings described in the Background have given validity as to the benefits of the exercise system (hereinafter interchangeably referred to as "exerCor"). The eXerCor requires the user to use Visual feedback via lines and/or lights to cue a movement pattern, while also using an object (an attached med ball and/or exercise band) to execute the movement within eXerCor system guidelines. Furthermore, eXerCor has a high energy demand. As stated above, brain glucose being the #1 consumer of energy, due to the task-oriented movement that is required in eXerCor's program system. The eXerCor requires many different cognitive sequences to be able to complete each exercise. All of which sequences have go through aforementioned processes collectively.

Science has shown that when learning a new task, stimulus heightens or excitability and the more potentiation for engram cells to encode and retrieve memory, just as it functions during rest. However, the stimulus is much greater during the use of eXerCor. The potential for more efficient engram cells communication to enhance the memory substantially through the use of eXerCor. Since the memory influenced by nothing more than the neuronal excitability cortical connection, it stands to reason that eXerCor would help potentiate these mechanisms based on eXerCor's exercise system. In sum, eXerCor directly involves multiple avenues of exercise which activate memory-related pathways!

The eXerCor exercise system increases the supply and demand for the brain and body to simultaneously produce a need for not only more energy for the exercise movements, but a greater demand for processing of more sensory information. In this way, this will activate more sarcomeres, recruiting more muscle fibers, thus causing greater force production. Increased excitability not only improves neuronal function but also allows forced production to utilize more sarcomeres to complete the exercise. This again, increases more excitability that eXerCor system provides for the fulfillment of its intended purpose and the completion of the exercise task.

eXerCor exercise system may directly stimulate these neurological and structural changes in these regions of the brain stated above by activating subsystems such as the neuromuscular system, cardiorespiratory system and fascial system (via the neuro-myofascial web).

Figure 1:
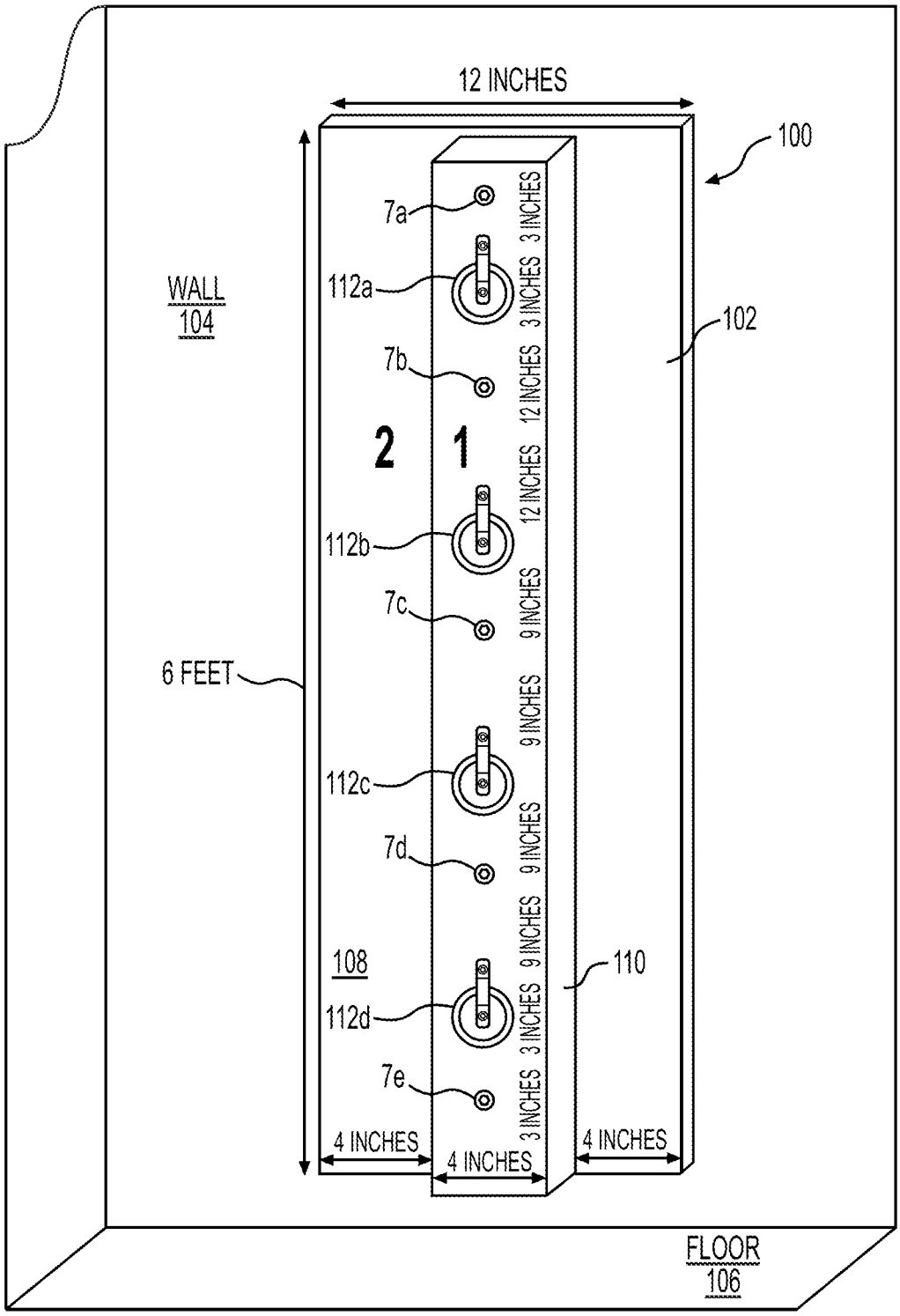
FIG. 1 depicts a front perspective view of the wall-mounted device of the present invention.

Referring first to FIG. 1, depicted is a front perspective view of the wall-mounted device 102 of the eXerCor exercise system 100 mounted to wall 104 above floor 106. Wall-mounted device 102 generally comprises wall plate 108 and beam 110 and is gun metal gray in color. Beam 110 is preferably a hollow aircraft aluminum beam that is 6 feet long (tall), 4" wide, and 2" deep. Five bolts 7*a*-7*e* are used to secure beam 110 to wall plate 108 and wall 104. Preferably bolts 7*a*-7*e* are attached to a stud in wall 104. Beam 110 further comprises four tiedown anchors 112*a*-112*d*. Each tiedown anchor 112*a*-112*d* is secured to beam 110 by two bolts.

Beam 110 is centered on wall plate 108, leaving four inches of wall plate 108 exposed on each side of beam 110. Wall plate 108 is preferably 6' long (tall), 12" wide, and has a gloss black color.

Tiedown anchor 112*a* is referred to as the Cervical Band Anchor. The center of tiedown anchor 112*a* is 6" from the top of beam 110 and is centered on the width of beam 110.

Tiedown anchor 112*b* is referred to as the Theracic Band Anchor. The center of tiedown anchor 112*b* is 30" from the top of beam 110 and is centered on the width of beam 110.

Tiedown anchor 112*c* is referred to as the Lumbar Band Anchor. The center of tiedown anchor 112*c* is 24" from the bottom of beam 110 and is centered on the width of beam 110.

Tiedown anchor 112*d* is referred to as the Sacral Band Anchor. The center of tiedown anchor 112*d* is 6" from the bottom of beam 110 and is centered on the width of beam 110.

Figure 3:
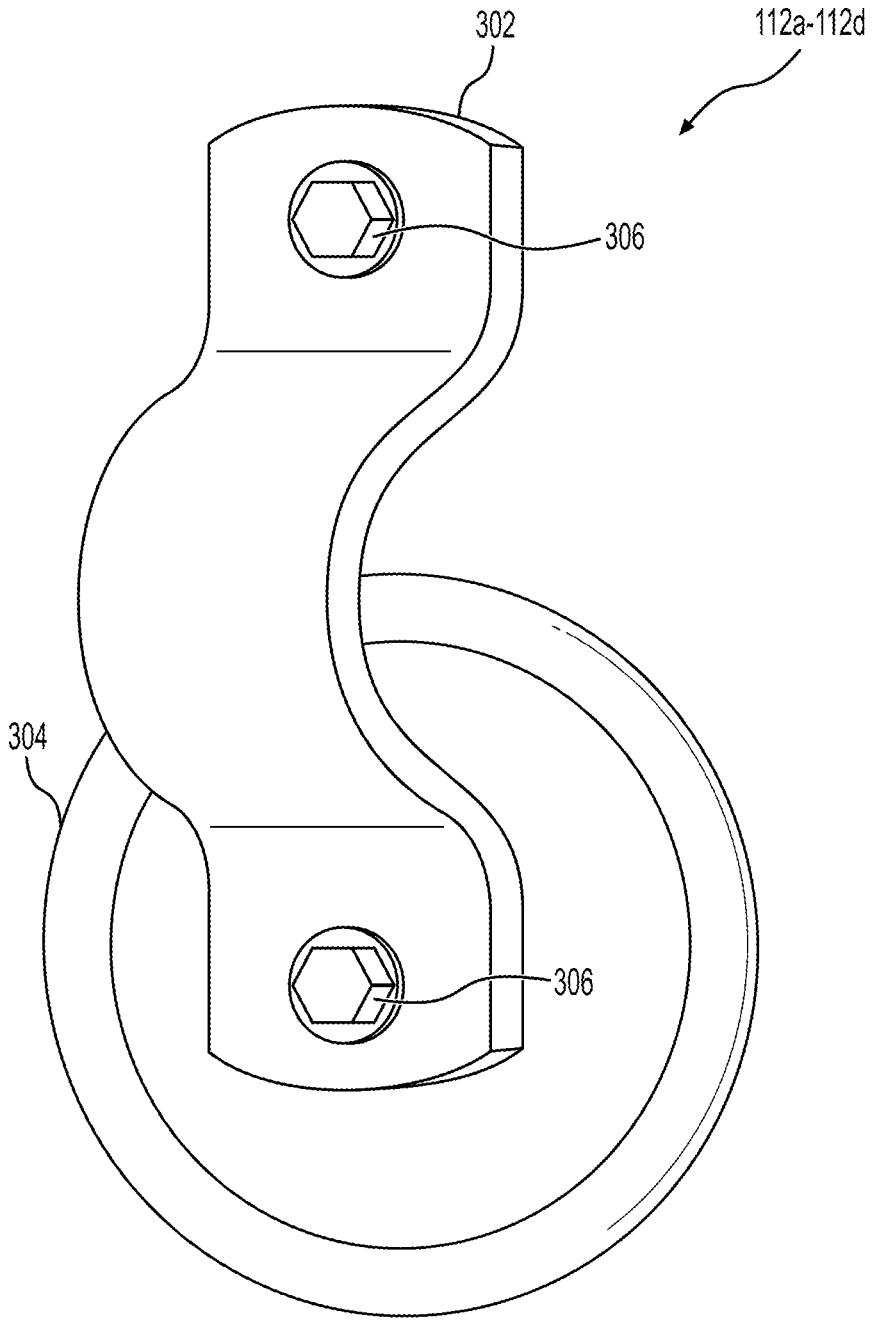
FIG. 3 depicts a view of the tiedown anchors.

FIG. 3 depicts an enhanced view of an individual tiedown anchor 112*a*-112*d*. For explanation, tiedown anchor 112*a* will be used for description, but all tiedown anchors 112*a*-112*d* are preferably identical in construction. Tiedown anchor 112*a*-112*d* is preferably 3.125" in length and 1.375" in width and has a gloss black color. Tiedown anchor 112*a* comprises metal strip 302, ring 304, and bolts 306. The bolts 306 are inserted through metal strip 302 and secure tiedown anchor 112*a* to beam 110. Metal strip 302 has a curved center through for accommodating ring 304 as shown. Ring 304 is preferably made from metal and is 2.5" in diameter and are spaced 2" apart. Each bolt 306 is 1.25" long and is secured to beam 110 using 2 washers and a nut.

Referring back to FIG. 1, each bolt 7*a*-7*e* is preferably 5" long. Bolt 7*a* is located 3" from the top of beam 110 and is centered between the 4" width. Bolt 7*b* is located 18" inches from the top of beam 110 and is centered between the 4" width. Bolt 7*c* is located 39" inches from the top of beam 110 and is centered between the 4" width. Bolt 7*d* is located 15" from the bottom of beam 110 and is centered between the 4" width. Bolt 7*e* is located 3" inches from the bottom of beam 110 and is centered between the 4" width.

Figure 2:
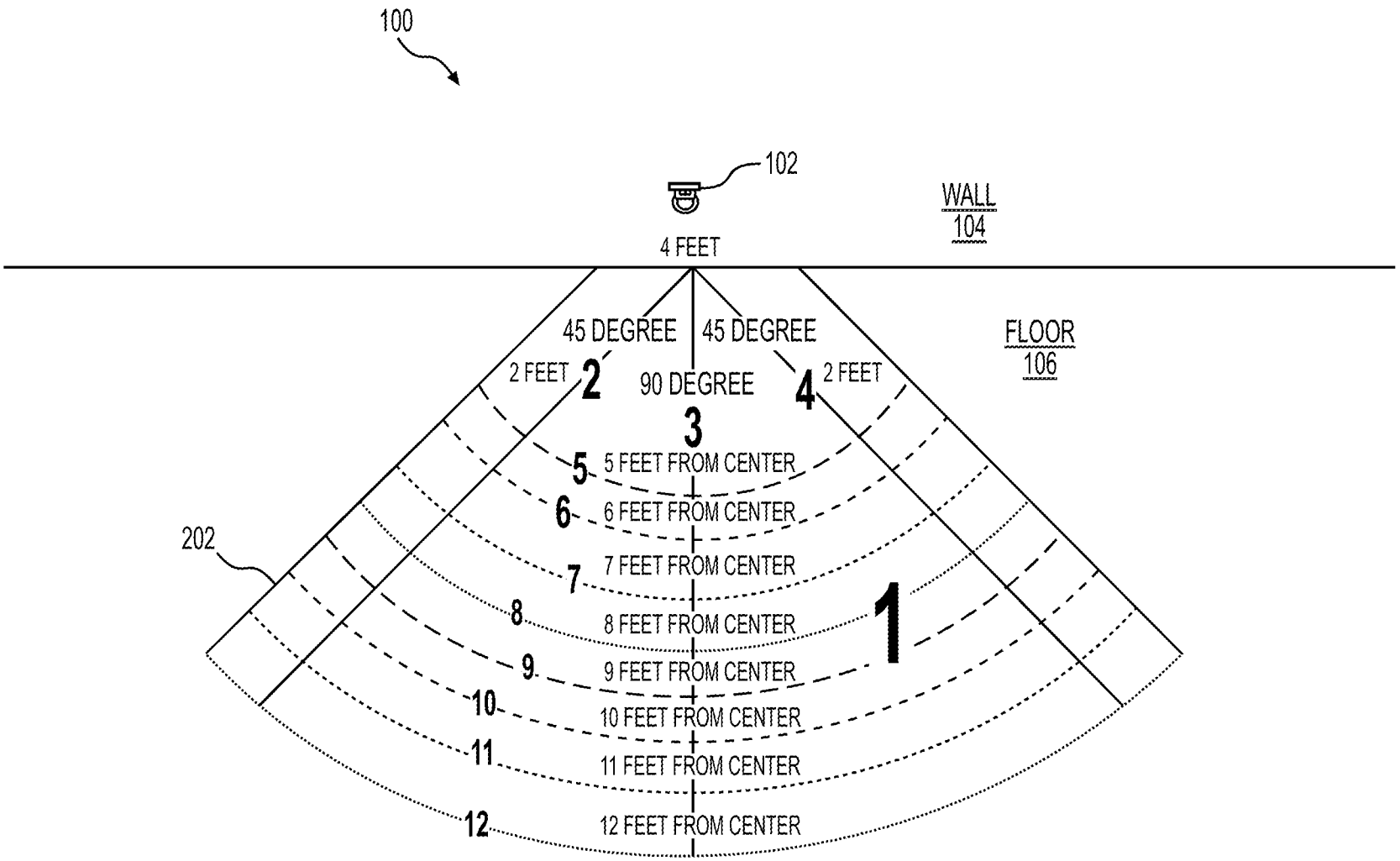
FIG. 2 depicts a top view of the exercise mat off the present invention.

FIG. 2 depicts a top view of exercise mat 202 positioned on floor 204 in front of wall-mounted device 102. Exercise mat 202 has a narrower front section of 4' so it can be positioned flush with wall 104 below wall-mounted device 102. Exercise mat 202 extends 12' from the wall in the shape of a baseball field. Preferably, exercise mat 202 is formed form a textures black rubber for better foot to floor contact that avoids slipping when wet, due to the textured instead of a flat mat surface. Exercise mat 202 comprises a plurality of lines that allow the user to confirm they are standing in the correct place and to progress in future workouts.

Exercise mat 202 addresses many issues that come with working with resistance bands. If the user stands 6' feet away from a tiedown anchor 112*a*-112*d* and works one side of the body and turns to work the other side of the body, but is standing 6.6 feet away now, imbalances develop in the body. Exercise mat 202 assures the user avoids such imbalances. Exercisers also have the challenge of figuring out how to progress in difficulty besides going to a thicker resistance band, because they don't know how far away from the anchor they were from last week. The lines on exercise mat 202 let the user always know how far away they are from tiedown anchor 112*a*-112*d* last week and advance and additional 6 inches or more. Exercise mat 202 comprises the following lines:

1. A gray line 2 mixed into the exercise mat 202, 2 inches wide, 12 feet long. The line 2 is at a 45 degree angle from the center of the wall-mounted device 102 mounted on the wall 104. Running down the center of the gray line 2 is a light strip. Lights will illuminate to both mark where the user should be looking to assure proper spine alignment as well as mark where the user is standing.

2. A gray line 3 mixed into the mat, 2 inches wide, 12 feet long. The line 3 is at a 90 degree angle from the center of the wall-mounted device 102 mounted on the wall 104. Running down the center of the gray line 3 is be a light strip. Lights will illuminate to both mark where the user should be looking to assure proper spine alignment as well as mark where the user is standing.

3. A gray line 4 mixed into the mat, 2 inches wide, 12 feet long. The line 4 is at a 45 degree angle from the center of the wall-mounted device 102 mounted on the wall 104. Running down the center of the gray line 4 is a light strip. Lights will illuminate to both mark where the user should be looking to assure proper spine alignment as well as mark where the user is standing.

4. A gray line 5 mixed into the mat, 2 inches wide, 5 feet from the center of the mounted wall-mounted device 102 in the shape of an arc. Centered in the middle of the 2 inch thick line 5 is a 0.5 inch green line that runs the length. The addition of the extra color in the line 5 helps the user easily recognize which line they are standing on. Running down the center of the green line is be a light strip. Lights will illuminate to both mark where the user should be looking to assure proper spine alignment as well as mark where the user is standing.

5. A gray line 6 mixed into the mat, 2 inches wide, 6 feet from the center of the wall-mounted device 102 in the shape of an arc. Centered in the middle of the 2 inch thick line 6 is a 0.5 inch yellow line that runs the length. The addition of the extra color in the line 6 helps the user easily recognize which line they are standing on. Running down the center of the yellow line is a light strip. Lights will illuminate to both mark where the user should be looking to assure proper spine alignment as well as mark where the user is standing.

6. A gray line 7 mixed into the mat, 2 inches wide, 7 feet from the center of the wall-mounted device 102 in the shape of an arc. Centered in the middle of the 2 inch thick line 7 is a 0.5 inch blue line that runs the length. The addition of the extra color in the line 7 helps the user easily recognize which line they are standing on. Running down the center of the blue line is a light strip. Lights will illuminate to both mark where the user should be looking to assure proper spine alignment as well as mark where the user is standing.

7. A gray line 8 mixed into the mat, 2 inches wide, 8 feet from the center of the wall-mounted device 102 in the shape of an arc. Centered in the middle of the 2 inch thick line 8 is a 0.5 inch red line that runs the length. The addition of the extra color in the line 8 helps the user easily recognize which line they are standing on. Running down the center of the red line is a light strip. Lights will illuminate to both mark where the user should be looking to assure proper spine alignment as well as mark where the user is standing.

8. A gray line 9 mixed into the mat, 2 inches wide, 9 feet from the center of the wall-mounted device 102 in the shape of an arc. Centered in the middle of the 2 inch thick line 9 is a 0.5 inch green line that runs the length. The addition of the extra color in the line helps the user easily recognize which line they are standing on. Running down the center of the green line is a light strip. Lights will illuminate to both mark where the user should be looking to assure proper spine alignment as well as mark where the user is standing.

9. A gray line 10 mixed into the mat, 2 inches wide, 10 feet from the center of the wall-mounted device 102 in the shape of an arc. Centered in the middle of the 2 inch thick line 10 is a 0.5 inch yellow line that runs the length. The addition of the extra color in the line 10 helps the user easily recognize which line they are standing on. Running down the center of the yellow line is a light strip. Lights will illuminate to both mark where the user should be looking to assure proper spine alignment as well as mark where the user is standing.

10. A gray line 11 mixed into the mat, 2 inches wide, 11 feet from the center of the wall-mounted device 102 in the shape of an arc. Centered in the middle of the 2 inch thick line 11 is a 0.5 inch blue line that runs the length. The addition of the extra color in the line 11 helps the user easily recognize which line they are standing on. Running down the center of the blue line is a light strip. Lights will illuminate to both mark where the user should be looking to assure proper spine alignment as well as mark where the user is standing.

11. A gray line 12 mixed into the mat, 2 inches wide, 12 feet from the center of the wall-mounted device 102 in the shape of an arc. Centered in the middle of the 2 inch thick line 12 is a 0.5 inch red line that runs the length. The addition of the extra color in the line 12 helps the user easily recognize which line they are standing on. Running down the center of the red line is a light strip. Lights will illuminate to both mark where the user should be looking to assure proper spine alignment as well as mark where the user is standing.

Figure 4:
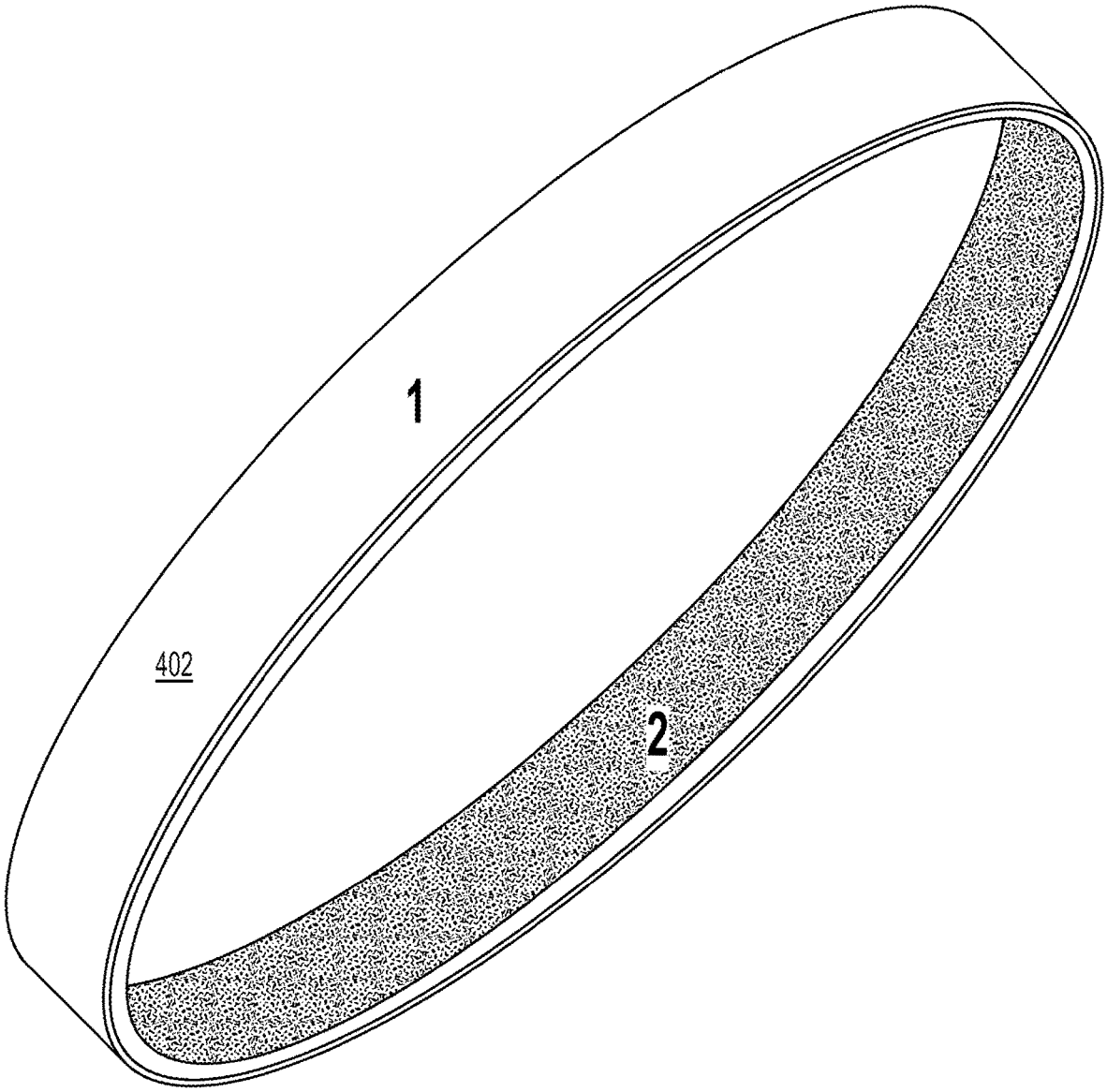
FIG. 4 depicts a view of a resistance band.
Figure 5:
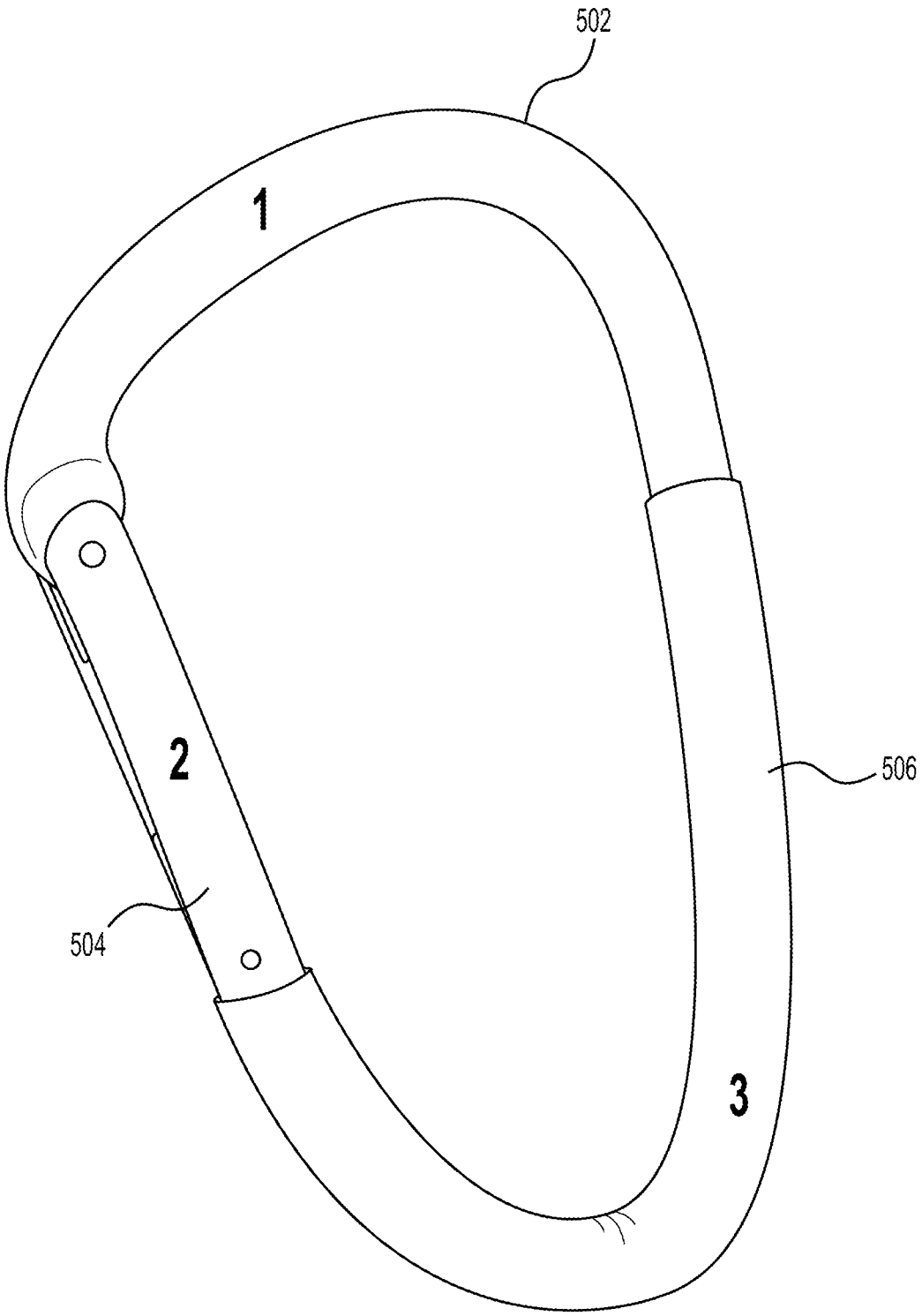
FIG. 5 depicts a view of a carabineer.

FIG. 4 depicts an example of a resistance band 402 which can be coupled to a ring 304 using carabineer (FIG. 5). The resistance band 402 is preferable circular and formed from rubber, having an unstretched circumference of 84". An inside of all resistance bands 402 is preferably black and grey whereas the outer surfaces have different colors for differentiation. In a preferred embodiment, there are five different types of resistance bands 402:

1. The thinnest resistance band 402 is 0.25 inches thick (5-10 lbs) and white on the outside of the band.
2. The second resistance band 402 is 0.5 inches thick (15-30 lbs) and green on the outside of the band.
3. The third resistance band 402 is 0.75 inches thick (25-65 lbs) and yellow on the outside of the band.
4. The second thickest resistance band 402 is 1.25 inches thick (35-85 lbs) and blue on the outside of the band.
5. The thickest resistance band 402 is 1.75 inches thick (50-125 lbns) and red on the outside of the band.

As shown in FIG. 5, the carabineer 502 is a large aluminum carabineer 6.5" in length and 3.75" in width at the widest point and 2.5" wide at the narrowest point. Quick release lever 504 is preferably chrome and 3.5" in length. Black foam 506 covers the base of carabineer 502. This assures the attached resistance band 402 stays in place and reduces the likelihood of a band snapping, rubbing against a metal surface. Black foam 506 is 6.25" inches in length.

Figure 6:
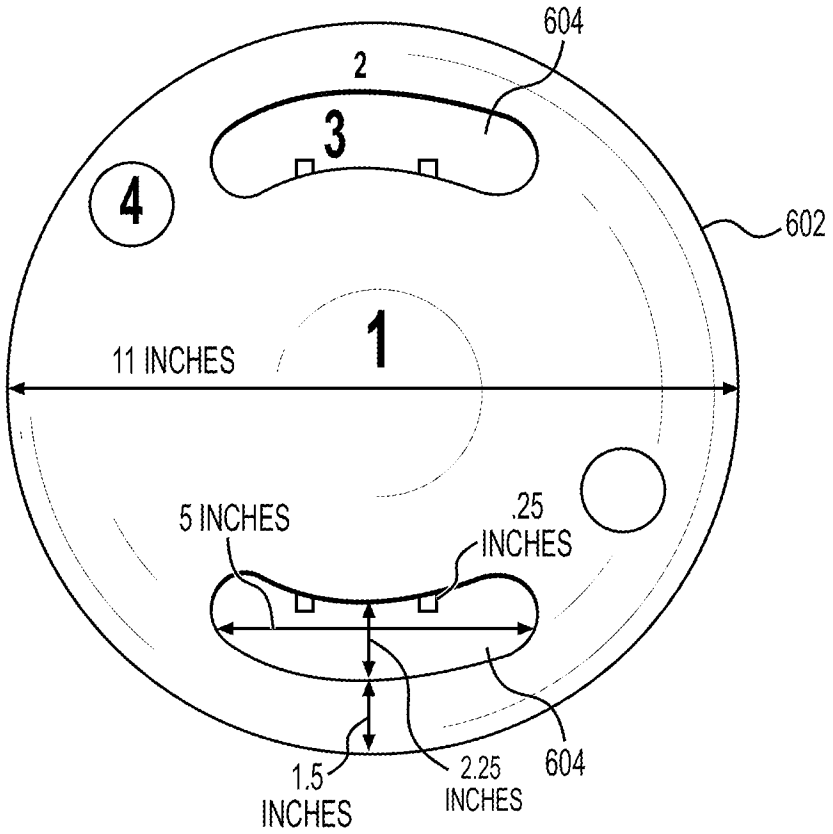
FIG. 6 depicts a view of a medicine ball.

FIG. 6 depicts medicine ball 602 that can be coupled to another end of resistance band 402 using a carabineer 502. The medicine ball 602 is 11" in diameter with two handles 604. Each handle is 1.5" thick to comfortably fit in the user's hand. The size of the space between the handle 604 and the medicine ball 602 is 5" inches wide, to fit a hand, and 2.25" deep, to support a rail system in it to fit a glove in to add more comfort to the user. There are two rails inside each handle space, located on the ball (not the handle) the rails make it easy to slip a glove on or off the track for added comfort and stability to the system. A button on the side of the medicine ball 602 ball is the rail release. By pushing the button in, a pin is moved laterally and releases the glove from the rail system.

Figure 7:
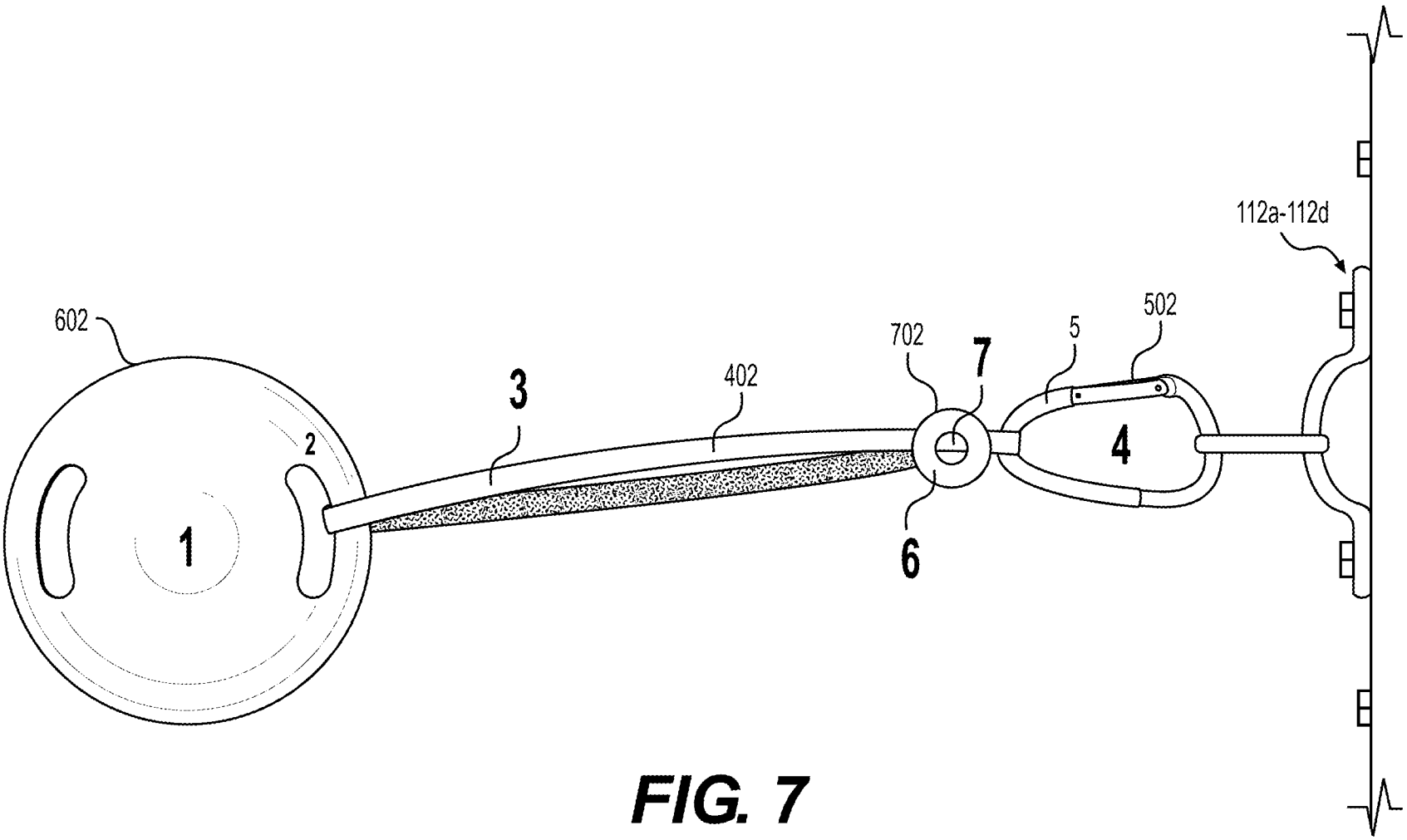
FIG. 7 depicts a view of the carabineer, medicine ball, and resistance band combined.

FIG. 7 depicts medicine ball 602 coupled to resistance band 402 and carabineer 502. The black foam 506 has a small cut the foam (as wide as the resistance band 402) so the resistance band 402 and the carabineer 502 are one unit. A one pound weight 702 in the shape of a sphere 2" in diameter is positioned along the resistance band 402. The weight 702 is preferably a matte gray color. A spring in the center of weight 702 holds the weight 702 in place. A button on the weight 702, when depressed, compresses a spring and allows the user to move weight 702 along the length of resistance band 402. The further center the weight 702 is moved, the more instability that is produced, challenging stabilizing muscles further and burning more calories and requiring more mental focus from the user.

The invention claimed is:

1. An exercise system comprising:
- a wall mount, wherein the wall mount has a plurality of tiedown anchors in vertical alignment;
- at least one resistance band releasably coupled to at least one tiedown anchor;
- at least one handle releasably coupled to the at least one resistance band;
- an exercise mat,
- wherein the exercise mat comprises:
  - a plurality of radial lines spaced at predetermined distances from the wall mount,
  - wherein a front of the exercise mat is narrower than a rear end of the exercise mat;
- a medicine ball coupled to the at least one resistance band,
- wherein the medicine ball comprises a first handle and a second handle.

2. The exercise system of claim 1, wherein the plurality of tiedown anchors are equally spaced.

3. The exercise system of claim 1, wherein the wall mount comprises:
- a wall plate for coupling the wall mount to studs of a wall; and
- a beam coupled to a front of the wall plate,
- wherein the plurality of tiedown anchors are coupled to the beam.

4. The exercise system according to claim 3, wherein the beam is hollow and formed from aluminum.

5. The exercise system according to claim 1, wherein each tiedown anchor comprises:
- a first end having a first opening;
- a second end having a second opening;
- a raised center portion having a curve coupled to the first end and the second end; and
- a metal ring,
- wherein the raised center portion passes through a center of the metal ring.

6. The exercise system according to claim 1, wherein the plurality of radial lines are equally spaced.

7. The exercise system according to claim 1, wherein the exercise mat further comprises:
- a first line extending from a front to a rear of the exercise mat,
- wherein the first line forms a 45° angle with a wall when the front of the exercise mat contacts a wall.

8. The exercise system according to claim 7, where in the exercise mat further comprises:
- a second line extending from the front to the rear of the exercise mat,
- wherein the second line forms a 135° angle with the wall when the front of the exercise mat contacts the wall.

9. The exercise system according to claim 8, wherein the first line comprises a first light strip and the second line comprises a second light strip.

10. The exercise system according to claim 8, wherein the first line and the second line intersect at 90° angle.

11. The exercise system according to claim 1, wherein each of the plurality of radial lines forms an arc.

12. The exercise system according to claim 1, wherein each of the plurality of radial lines comprises a different color.

13. The exercise system according to claim 1, wherein each of the plurality of radial lines comprises a light strip.

14. The exercise system according to claim 1, wherein a center of the exercise mat is aligned with a center of the wall mount during exercise.

15. The exercise system according to claim 1, further comprising:

a weight positioned along a length of the at least one resistance band, herein the weight is fixed in a position along the length by a compression spring.

16. An exercise system comprising:

a wall mount, wherein the wall mount has a plurality of tiedown anchors in vertical alignment;

at least one resistance band releasably coupled to at least one tiedown anchor;

at least one handle releasably coupled to the at least one resistance band; and an exercise mat, wherein the exercise mat comprises:

a plurality of radial lines spaced at predetermined distances from the wall mount, wherein a front of the exercise mat is narrower than a rear end of the exercise mat, and wherein each of the plurality of radial lines comprises a light strip.

17. An exercise system comprising:

a wall mount, wherein the wall mount has a plurality of tiedown anchors in vertical alignment;

at least one resistance band releasably coupled to at least one tiedown anchor;

at least one handle releasably coupled to the at least one resistance band; and an exercise mat, wherein the exercise mat comprises:

a plurality of radial lines spaced at predetermined distances from the wall mount, wherein a front of the exercise mat is narrower than a rear end of the exercise mat, wherein the wall mount comprises:

a wall plate for coupling the wall mount to studs of a wall; and a beam coupled to a front of the wall plate, wherein the plurality of tiedown anchors are coupled to the beam.

* * * * *